United States Patent [19]

Fralick

[11] 3,995,766

[45] Dec. 7, 1976

[54] SNAP-OPEN CONTAINER

[75] Inventor: Jack Frederick Fralick, Havre de Grace, Md.

[73] Assignee: Kiwi Polish Company, Pottstown, Pa.

[22] Filed: July 18, 1975

[21] Appl. No.: 597,214

[52] U.S. Cl. ..... 220/282; 220/352

[51] Int. Cl.[2] ..... B65D 43/04

[58] Field of Search ..... 220/282, 281, 352; 215/301, 282, 352

[56] References Cited

UNITED STATES PATENTS

| | | | |
|---|---|---|---|
| 3,089,608 | 5/1963 | Burdick et al. | 220/282 |
| 3,504,821 | 4/1970 | Wolbers | 220/282 |
| 3,741,431 | 6/1973 | Burdick | 220/282 |

*Primary Examiner*—George E. Lowrance
*Assistant Examiner*—Steven M. Pollard
*Attorney, Agent, or Firm*—John J. Byrne; Edward E. Dyson

[57] ABSTRACT

A paste container having a base and a cover. These parts are equipped with fulcra points to tiltably open the container while the cover is temporarily held to the base.

10 Claims, 4 Drawing Figures

SNAP-OPEN CONTAINER

BACKGROUND OF THE INVENTION

1. Field of the Invention

This invention relates generally to snap-open containers and especially to snap-open containers of the type wherein the opening operation is effected with one hand. The invention further relates to containers comprising a container body with an access opening surrounded by an upstanding circular wall and a cover for the opening having a peripheral skirt which fits tightly around the wall to effect a seal, said cover having formed on said skirt circumferentially spaced indentations which seat on a body wall to form fulcra points about which the cover may be tilted from the closed position to an open or partially open position.

2. Description of the Prior Art

Prior art snap-open containers often position the fulcra points such that the cover of the container is completely detached from the body at the end of the snap open operation. Typical of such containers is that disclosed in the Burdick et al U.S. Pat. No. 3,067,906. There are several drawbacks to this prior art method of operation. For instance, the body of the container may become completely detached from the cover at the end of the snapping operation such that the body may be forced to slide from under the cover and possibly out of the hands. This often requires the addition of a retention means. Such means have been disclosed in British Pat. 1,158,582 filed Oct. 26, 1965, the structure of which provides a depression constituting an abutment or stop for the body wall to prevent the body from becoming completely detached from the cover at the end of the snapping operation. This invention provides an improved solution to this problem.

SUMMARY OF THE INVENTION

A principal feature of the present invention is in the relative dimensioning of the diameters of the peripheral skirt and the upstanding circular wall and the provision of fulcra points and an annular depression in the body wall to produce an interference between the container body wall and the body cover skirt when the cover is in its tilted position. In the present invention, as the cover is tilted to an open position, the cover jams on the body creating enough pressure at the radial contact points to prevent the cover from completely releasing the body portion and thereby causing a second operation to completely remove the cover.

A principal object of this invention is to provide a construction in snap-open containers by which the container cover portion is maintained on the body portion by interference means thereby preventing the cover from becoming completely detached from the body and possibly having both escape the hand.

DESCRIPTION OF THE DRAWINGS

For a better understanding of the invention, reference is made to the following description of a representative embodiment thereof and to the accompanying drawings wherein.

DESCRIPTION OF AN EMBODIMENT

Figure 1:
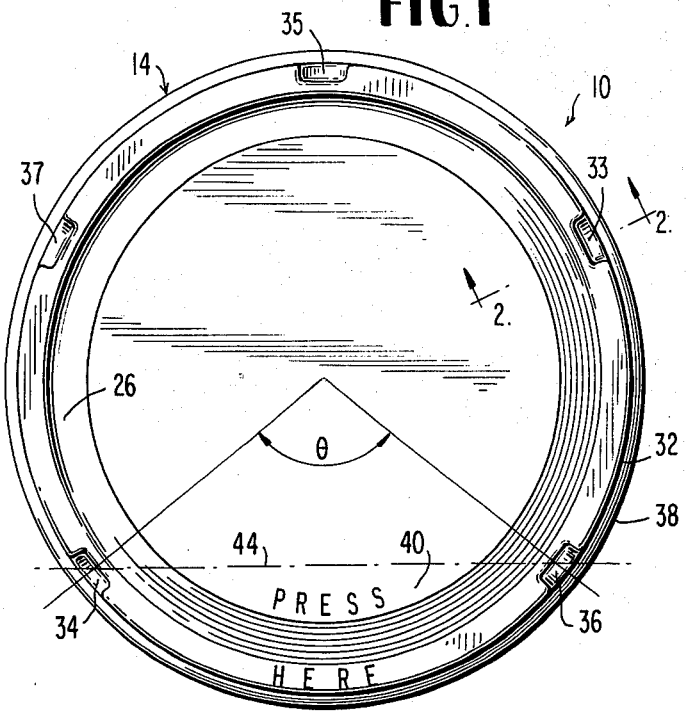
FIG. 1 is a plan view of a container top.
Figure 2:
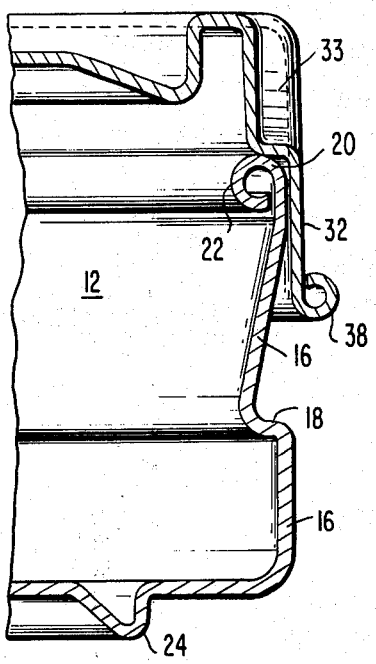
FIG. 2 is a partial cross-sectional view of the container top through the line 2—2 in FIG. 1.
Figure 3:
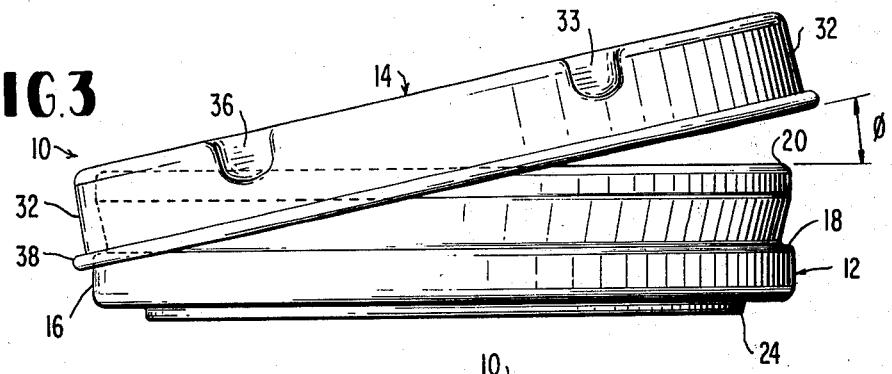
FIG. 3 is a side view of the container with one side of the cover in the depressed position.

Referring now to FIGS. 1 through 3 wherein like elements are similarly numbered, a container 10 includes a body portion 12 and a cover portion 14. The body portion 12 has an upstanding circular wall 16 provided with an inwardly directed annular shelf 18 of lesser diameter than a rim curl 20. Shelf 18 is formed by inwardly tapering the upper portion of the body wall from a body rim curl 20. Cover 14 has a cylindrical skirt 32 terminated by an outward curl 38. Circumferentially spaced, relatively shallow indentations 33, 34, 35, 36 and 37 are formed in the periphery of the upper edge of skirt 32. In the closed position, the five indentations seat on the rim 20 of the wall 16. The lower surfaces of indentations 34 and 36 are formed with an arcuate undersurface to facilitate a "rocking" as hereinafter described. While all five indentations are alike, it is indentations 33, 35 and 37 that serve as stops to limit the compression of the lid when placing it on the container. Indentations 34 and 36 provide the fulcra points about which the lid is tilted in the opening operation.

Body 12 and cover 14 are provided with a stacking feature. A base located circular rib 24 is receivable in a circular channel 26 of the cover portion.

Figure 4:
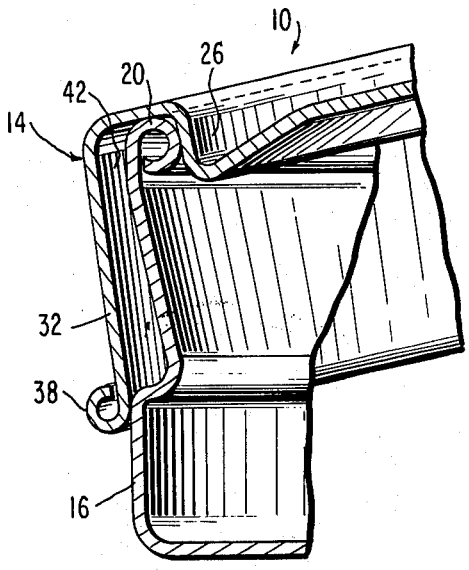
FIG. 4 is a partial cross-sectional view of the container body portion in the position of FIG. 3.

A principal feature of this invention is the interference developed by the relative dimensioning of the diameter of the skirt 32 and the body wall 16 in relation to the fulcra point indentations 34 and 36. The three dimensions cooperate to create a combined effect. To effect opening of the container, pressure (as by pinching as is common in the art) is applied at a point circumferentially midway between indentations 34 and 36. As cover 14 is depressed at appropriately marked area 40, it rotates about the horizontal axis of chord 44 defined by an imaginary line through indentations 34 and 36. The beaded cover rim 38 comes to rest momentarily in annular ledge 18. With continued application of vertical pressure, the cover 14 shifts outwardly and downwardly to the position of FIGS. 3 and 4 causing body rim 20 to lodge in a cavity 42 formed between the cover skirt 32 and stacking channel 26. This action causes the inner surface of the skirt 32, opposite curl 38, to contact body wall 16 just below ledge 18. In addition to the contact points developed between the cover and body portions in the aforesaid manner the inner surfaces of indentations 34 and 36 snuggly engage or jam on the rim 20 of the body wall as illustrated in FIG. 3. Sufficient interference is thereby developed to maintain cover 14 on body 12 with little pinching or depressing pressure.

Indentations 34 and 36 are positioned so that this depth provides the requisite leverage for removing the cover but not to permit the cover in its fully depressed position to be tilted beyond the angular displacement $\phi$. At angle $\phi$, adequate contact is developed between the indentations and the body rim to hold the cover upon the body.

The diameter of the container is chosen so that segment 40 provides adequate leverage to tilt the cover into its partially open position with the indentations 34 and 36 subtending an angle $\theta$ substantially less than 180°. If subtended angle $\theta$ approaches 180° the angular displacement $\phi$ necessary to tilt the cover to its partially open position becomes too large which can cause the cover to fly off the body, thereby defeating the purpose of this invention.

In the preferred embodiment of this invention indentations 34 and 36 subtend an angle $\theta$ of 104° and the cover assumes an angular displacement $\phi$ of 12° with respect to the body portion and an interference develops at the point of radial contact between the inner surfaces of indentations 34 and 36 and the body rim.

In a general manner, while there has been disclosed an effective and efficient embodiment of the invention, it should be well understood that the invention is not limited to such an embodiment as there might be changes made in the arrangement, disposition, and form of the parts without departing from the scope of the accompanying claims.

I claim:

1. A package for a semi-solid material such as shoe polish comprising, a cylindrical polish-containing body formed of a circular base and an annular wall extending upwardly thereabout, a first annular rim about the upper end of said wall forming an access opening, said wall having an annular depression between said bottom and said first rim, said first rim having an upper surface, a cover having a top portion, a skirt extending downwardly from the periphery of said top portion and terminated by a second annular rim that is in the plane of said depression when said cover is in closing relationship with said opening, the inner surface of said skirt forming a seal with the portion of said wall above said depression, first and second indentations having bottom and inner surfaces formed in said cover at the juncture of said top and said skirt and said indentations in engagement with the upper surface of said first rim when said cover is in said sealed position, a line intersecting said indentations defining a pivot axis, said indentations subtending an angle with respect to the geometrical center of said circular cover such that the inner surfaces of said indentations snuggly engage a portion of said first rim when said cover is tilted about said pivot axis.

2. The container of claim 1 wherein the indentations are located to subtend an angle of approximately 104° with respect to the geometric center of said cylindrical cover.

3. The container of claim 1 wherein the angular displacement of said cover portion is about 12° when said cover portion is in its fully depressed position.

4. The container of claim 1 wherein said second rim falls below said annular depression when said cover is tilted about said horizontal axis.

5. The container of claim 1 wherein said top portion of said cover contains a cavity formed between said cover skirt and a depression contained in said top portion to receive said first rim in said cavity as said cover is tilted.

6. The container of claim 1 wherein a cavity is formed between said cover skirt and a depression contained in said top portion whereby as said cover is tilted about said horizontal axis, said first rim is lodged in said cavity and said second rim positions itself at a point below said body wall depression.

7. The container of claim 4 wherein the indentations are located to subtend an angle of approximately 104° with respect to the geometric center of said cylindrical cover.

8. The container of claim 5 wherein the indentations are located to subtend an angle of approximately 104° with respect to the geometric center of said cylindrical cover.

9. The container of claim 6 wherein the indentations are located to subtend an angle of approximately 104° with respect to the geometric center of said cylindrical cover.

10. The container of claim 6 wherein the angular displacement of said cover portion is about 12° when said cover portion is in its fully depressed position.

* * * * *

UNITED STATES PATENT OFFICE

CERTIFICATE OF CORRECTION

Patent No. 3,995,766 Dated December 7, 1976

Inventor(s) Jack Frederick Fralick

It is certified that error appears in the above-identified patent and that said Letters Patent are hereby corrected as shown below:

The name of the assignee is incorrect in the above-identified Letters Patent. Therefore, the name of the assignee should be changed from "Kiwi Polish Company" to "The Kiwi Polish Company (U.S.A.)".

Signed and Sealed this

Third Day of May 1977

[SEAL]

*Attest:*

RUTH C. MASON
*Attesting Officer*

C. MARSHALL DANN
*Commissioner of Patents and Trademarks*